United States Patent [19]

Buchmann

[11] 4,140,312

[45] Feb. 20, 1979

[54] STATIONARY EXERCISE BICYCLE

[76] Inventor: Rudolf C. Buchmann, Am Bogen 31, Mannheim-Feudenheim, Fed. Rep. of Germany

[21] Appl. No.: 743,513

[22] Filed: Nov. 19, 1976

[30] Foreign Application Priority Data

Nov. 21, 1975 [SE] Sweden ..... 7515107

[51] Int. Cl.[2] ..... A63B 69/16

[52] U.S. Cl. ..... 272/73; 272/134

[58] Field of Search ..... 272/73, 71, 72, 134, 272/144; 128/25 R; D34/5 K

[56] References Cited

U.S. PATENT DOCUMENTS

| | | | |
|---|---|---|---|
| 2,855,200 | 10/1958 | Blickman | 272/134 X |
| 3,017,180 | 1/1962 | Aronsohn | 272/73 |

FOREIGN PATENT DOCUMENTS

| | | | |
|---|---|---|---|
| 2302296 | 7/1974 | Fed. Rep. of Germany | 272/73 |
| 2436748 | 2/1975 | Fed. Rep. of Germany | 272/73 |
| 2408674 | 8/1975 | Fed. Rep. of Germany | 272/134 |
| 1507119 | 11/1967 | France | 272/73 |
| 461839 | 10/1968 | Switzerland | 272/73 |

*Primary Examiner*—Richard T. Stouffer
*Assistant Examiner*—Arnold W. Kramer
*Attorney, Agent, or Firm*—Saul Jecies

[57] ABSTRACT

An adjustable multi-purpose stationary exercise bicycle is disclosed. The bicycle has a frame provided with a pedal mechanism and with a first seat located at a level higher than the pedal mechanism. An additional component is provided, having a second seat and a member which is movable between a portion in which it forms a backrest for the second seat and another portion in which it forms an extension of the surface area of the second seat so that a user can lie thereon. The additional component is connectable with the frame in a plurality of positions. The novel device makes it possible for the arms or legs of a user to be located in horizontal or vertical orientation ahead of, behind or above the pedal mechanism while the arms or legs are used to operate the mechanism and thus to provide exercise for the user who may be seated or in a lying position.

6 Claims, 3 Drawing Figures

STATIONARY EXERCISE BICYCLE

BACKGROUND OF THE INVENTION

This invention relates to a multi-purpose physical exercising apparatus in form of a stationary exercise bicycle.

Stationary exercise bicycles have already been proposed in the prior art, having a pedal mechanism which must be operated by a user. One proposal suggests a device which is patterned after ordinary, mobile bicycles and wherein the pedals are operated with the user either positioned on a seat or else standing on the pedals and holding on to a support element of the frame. The vertical distance between the seat and the pedals can be adjusted.

Another proposal suggests the use of a support surface on which a user can be seated or lying, and which is so positionted that the user is at a level below the pedal mechanism. This support surface can be horizontally moved relative to the pedal mechanism so that a user can readily reach the pedals with his or her hands or feet. In both proposals it has been sugtested to make the position of the pedal mechanism itself vertically adjustable, so as to enable a user to carry out exercises requiring different kinds of leg positions.

According to the second proposal, the pedals do not usually act upon a mass (such as a fly wheel) which offers any significant amount of inertia. This is unlike the first-mentioned proposal, wherein such a mass is generally provided. The devices according to the second proposal are, as a general rule, intended to be of the collapsible, i.e. foldable type; this means that there is little room to provide a relatively large pedal mechanism and associated heavy intertial mass. The absence of such a mass, however, results in a non-uniform, jerking rotation of the pedal mechanism when the same is braked in order to increase the required operating force — and hence to demand greater exertion of the user's musculature. To some extent, this can be counteracted by the use of relatively short arms on the pedal mechanism.

It would be desirable to provide a device of the second type which is basically constructed as described above, but includes an Ergometer as known from the first-mentioned type of device, or a computer-controlled energy-measuring and indicating device. From a practical point of view, however, the high costs of these items of equipment (i.e. Ergometer and the like) makes this impossible because such equipment may cost between twice and four times the price of the basic exercise device.

SUMMARY OF THE INVENTION

It is an object of the invention to avoid the disadvantages of the prior art.

More particularly, it is an object of this invention to provide a multi-purpose stationary exercise bicycle which permits the use of inertial masses in the types of situations for which either the first-mentioned or the second-mentioned prior-art proposals were conceived, i.e. wherein the user either stands or sits at a level above the pedal mechanism, or sits or lies at a level lower than the pedal mechanism.

In accordance with these and still other objects, one feature of the invention resides in a stationary exercise bicycle comprising a frame; a pedal mechanism on the frame; a seat on the frame at a level above the mechanism; body support means for supporting the body of a user in any of a plurality of different positions; and connecting means for connecting the body support means to the frame in any of a plurality of different positions in which the body support means is located above, ahead or behind the mechanism, and in all of which the mechanism is engageable and operable by the extremities of a user.

The invention will hereafter be described with reference to exemplary embodiments. However, these are not to be considered limiting, it being understood that the scope of protection sought is defined exclusively in the appended claims.

DESCRIPTION OF THE PREFERRED EMBODIMENTS

Figure 1:
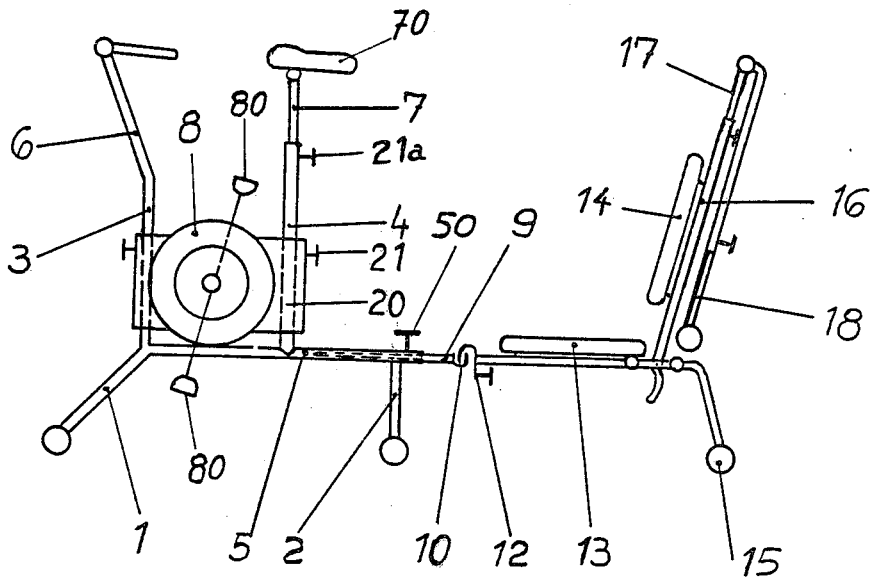
FIG. 1 is a diagrammatic side view illustrating one embodiment of the invention.
Figure 2:
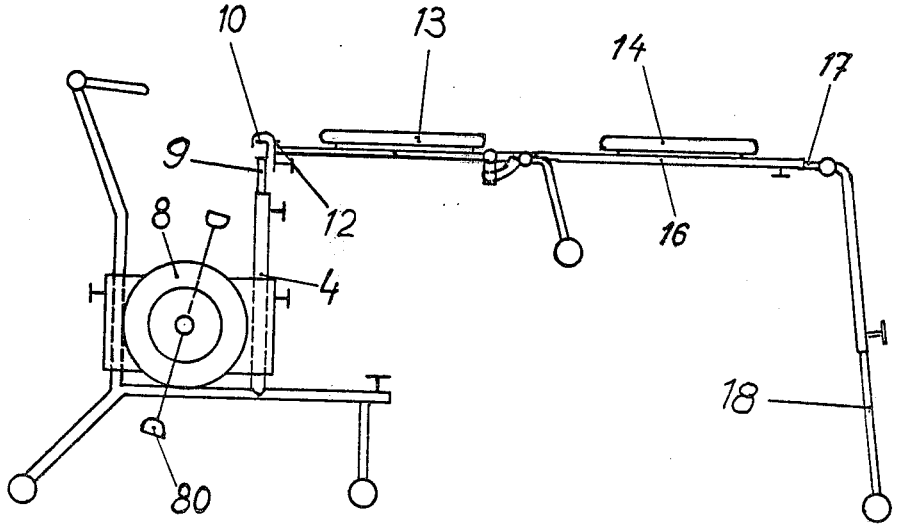
FIG. 2 is a view similar to the one in FIG. 1, but illustrating the device of FIG. 1 in a differently adjusted operating condition.

The multi-purpose exercise device of FIGS. 1 and 2 has a front ground support 1 and a rear ground support 2 for a frame composed of parts 3, 4 and 5. It also has an upright 6 for the handle bar, an upright 7 for a saddle 70, and a pedal mechanism 8 with a (not illustrated) inertial mass.

Parts 3 and 4 have tubular uprights 20 which are embraced by the portions of pedal mechanism 8, the latter having screws 21 by means of which it can be arrested in desired vertical positions relative to the uprights 20. Upright 7 is matingly received in the associated upright 20 and can be arrested in desired vertical position relative thereto by set screw 21*a*, so that the position of saddle 70 can be adjusted.

Frame part 5 is of polygonal (preferably quadratic) hollow cross-section into which a matingly shaped connecting member 9 is inserted, the connecting member being arrestable by a set secrew 50. The outer end of member 9 is provided with a U-shaped transverse portion 10, of e.g. 25 cm width, unto which a profiled element 12 having a flat seat 13 is pushed in lateral direction. Legs 15 support the seat 13 on the ground.

A member 14 is connected to the seat 13, so as to be both pivotable and arrestable relative thereto. For this purpose two arms 16 are provided (only one shown) in form of polygonal (preferable quadratic) tubes in which rods 17 (only one shown) are matingly and slidably received. A supporting frame 18 is connected to the rods 17 and is pivotable and arrestable relative thereto.

When the device is to be used in the configuration shown in FIG. 1, a user positions himself on saddle 70. When he rotates the pedals 80 of mechanism 8, he simulates normal bicycling since he exerts his body weight which is located above the mechanism 8.

If the user sits on seat 13 and rests his back against the member 14 which is in the illustrated position in which it acts as a backrest, then his legs are in substantially horizontal position when he operates the pedals 80. Therefore, the body weight is supported by seat 13 and the force required to turn the pedals 80 is exclusively provided by the user's musculature.

When the device is to be used in the configuration shown in FIG. 2, the saddle 70 and upright 7 are removed. The member 9 is inserted into the tube 20 of frame part 4, in place of the upright 7. Arms 16 and member 14 (the latter is preferably always of the upholstered type) are folded to horizontal position and so supported at a level above and behind the mechanism 8 — by the frame 18 which is pivoted to rod 17 and is vertically adjustable — that a user can operate the pedals 80 with his hands while resting on his belly.

Ground supports 1 and 2 may be in form of telescopable and arrestable tubes, to permit the distance from the mechanism 8 to the ground to be varied.

Figure 3:
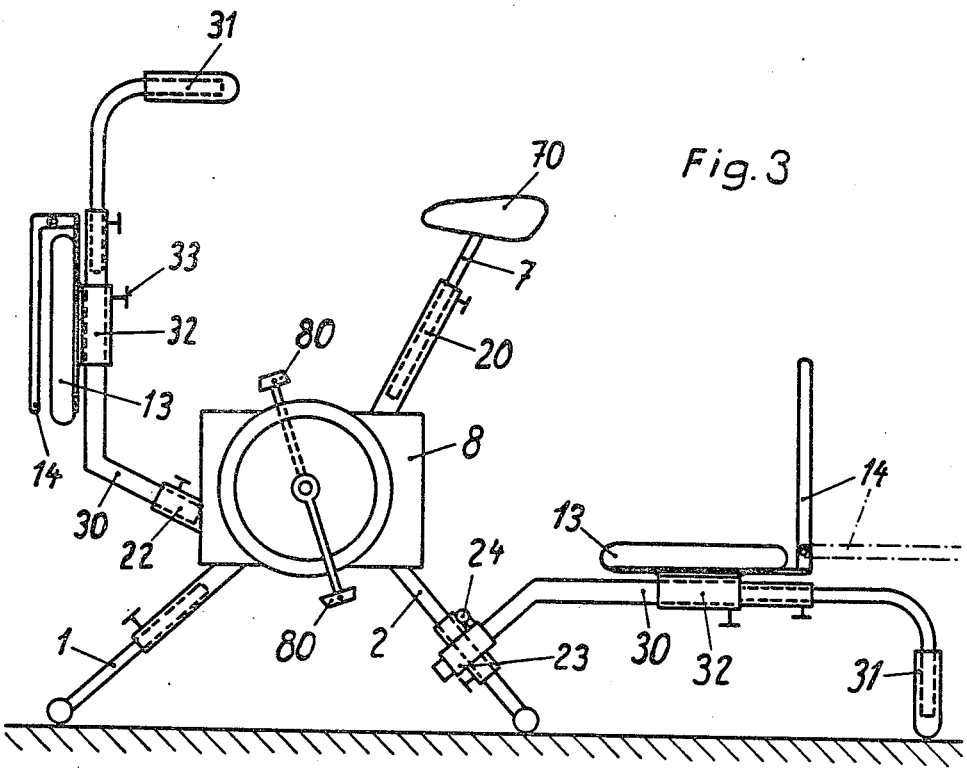
FIG. 3 is a view analogous to FIG. 1, showing a somewhat different embodiment.

FIG. 3 shows a somewhat different embodiment in which elements corresponding to those of FIGS. 1 and 2 have been assigned the same reference numerals.

This embodiment has a socket 22 in which an upright 30 is received which carries vertically adjustable handle bars 31. Seat 13 with member 14 pivotably connected thereto, is adjustably secured to upright 30 in a tubular socket 32 and a set screw 33.

When the device of FIG. 3 is to be used as a horizontal exerciser, upright 30 is pulled out of socket 22 and inserted into socket 23 which is mounted on the rear ground support 2 via a joint 24, so as to be pivotable and vertically adjustable. Vertical adjustability is required to permit upright 30 to be positioned (and maintained) in horizontal orientation when the pedal mechanism 8 is raised or lowered via the ground support 1 at the front end of the device.

Seat 13 can be shifted relative to the pedal mechanism 8 via socket 32; member 14 can be placed in upright position as shown, to act as a backrest. However, it can also be tilted to a horizontal position (shown in broken lines) or to intermediate position, to make it possible for a user to lie on his belly on the surfaces of members 13 and 14 while operating the pedals 80 with his hands.

If desired, the upright 30 may be inserted into socket 20, in place of the upright 7. Handle bar 31 must then be made longer to extend to the ground, so that once again a horizontal support surface is obtained for a belly-down position of the user; this time, however, the support surface will be at a level above the pedal mechanism.

It will be evident from the above that by repositioning of the upright 30, the same is made to perform a triple function, thus making for a highly versatile but simple device.

The component having, in FIG. 1, the members 12–18 and in FIG. 3 the members 2 and 13, 14, 30, 31 and 32, may instead be so constructed that the horizontal supporting members for the seat are constructed as —or may serve for— a simple-track or a multi-track guide for a rowing seat or as holding devices for arrangements which permit rowing motions to be carried out. The rowing seat itself will then be provided with a device for arresting it on and relative to the guide, so that a user can sit on this seat and operate the pedals. If it is desired to operate the pedals while lying on one's belly, as in FIG. 2, then the guide is provided with an additional tiltable and vertically adjustable element.

From the description of the above two exemplary embodiments it will be evident that the purposes and objects of the invention have been achieved. Bicycle-type exercising devices in accordance with the invention are much more versatile than before and can be employed not only by a user in upright seated or standing position, but also in semi-reclining or in lying-down position.

A user is now able to operate the device in many more positions of his body than before, including positions above, in front of, behind and below the pedal mechanism, and he can operate the pedals with his hands as well as with his feet.

In the bicycle-type exercise devices proposed in the prior art it has been suggested to adjust the pedal mechanism in vertical direction; however, this is done only to increase the convenience of a user in operating the pedals. In the device according to the present invention, however, the relative position of the pedal mechanism and of the support on which the body of a user rests, i.e. is supported, can be so adjusted in vertical direction that maximum stressing of e.g. the abdominal muscles can be obtained by selecting an extreme angle of attack of the user's legs relative to the pedals. Furthermore, the novel device also permits the user to operate the pedals with his arms in a position not previously possible, in that the relative distance between pedal mechanism and body support surface is adjustable.

When exercises to strengthen arm and chest muscles are to be carried out from a belly-down position with devices proposed in the prior art, the pedal mechanism is located forwardly of and above the head of the user, within reach of his hands. To be able to turn the pedals it is necessary for the user to raise the upper part of his body, whereby his spinal column becomes bent in a downwardly concave shape, i.e. in a flat U-shape. Such a position, however, leads inevitably to rapid tiring of the person involved. This is undesirable, especially for e.g. swimmers who should be able to carry out training exercises over protracted periods of time in a comfortable position and with regulatable expenditure of bodily energy and natural arm movements, as is characteristic for crawl swimming.

The device according to the invention achieves these purposes by making it possible to locate the flat seat (i.e. the element 13 alone or combined with the element 14 into a single flat support) by itself or in combination with the normal bicycle seat (i.e. seat 70) above the pedal mechanism. This permits the user to reach the pedals from a substantially vertical position or from an inclined position. The angle of inclination can, if desired, be so selected that the legs are located at a level higher than the upper part of the torso, to obtain an increased flow of blood to the chest and the head.

The possibility of locating the surface of seat 13, or the combined surfaces of seat 13 and element 14, at the same level or at a lower level than the pedal mechanism, and also to locate this surface ahead of or behind the mechanism, permits the user to orient his body in a manner, such that the pedals can be turned with the arms or legs of the user oriented either horizontally or in an upward inclination.

Naturally, when the user operates the device while lying down, he need not rest on his belly but could, instead, also rest on his back.

It should be understood that the invention is not to be considered limited to the illustrated and described embodiments and modifications, inasmuch as further modifications are possible within the scope of the invention. What is desired to be protected by Letters Patent is defined not hereinbefore, but in the appended claims.

I claim:

1. A stationary exercise bicycle, comprising a frame having a front and a rear ground support element, a front and rear socket and a seat socket;

a pedal mechanism on said frame;

a seat mounted in said seat socket at a level above said mechanism;

an element having a center portion and two spaced end portions which are both angled to one side of said center portion and one of which is provided with handle bars, and a body support mounted on said center portion, said element forming a support for a user on said seat when the other of said end portions is inserted in one of said sockets and a horizontal support when said other end portion is received in the other of said sockets and said handle bars of said one end portion engage the ground; and means mounting said body support on said center portion for adjustment along the same to permit varying of the distance between said body support and said pedal mechanism when said element forms a horizontal support.

2. An exercise bicycle as set forth in claim 1, wherein said body support comprises a seat portion and a backrest portion connected to said seat portion and movable relative thereto between an upright position in which it constitutes a backrest, a longitudinal position in which it constitutes an extension of said seat portion and a plurality of intermediate positions.

3. An exercise bicycle as set forth in claim 1, wherein said horizontal support constitutes a rowing trainer.

4. An exercise bicycle as set forth in claim 1, said element being a tubular element, and said front and rear sockets mounted on said frame and each dimensioned to receive said other end portion of said tubular element.

5. An exercise bicycle as set forth in claim 4, said sockets including a socket having a central axis and being mounted on said frame to be shiftable transverse to said axis.

6. An exercise bicycle as set forth in claim 1; and further comprising means for raising and lowering said pedal mechanism with reference to the ground.

* * * * *

UNITED STATES PATENT AND TRADEMARK OFFICE

CERTIFICATE OF CORRECTION

PATENT NO. : 4,140,312

DATED : Feb. 20, 1979

INVENTOR(S) : Rudolf C. Buchmann

It is certified that error appears in the above-identified patent and that said Letters Patent are hereby corrected as shown below:

On the title page in item [30],
"Sweden" should read -- Switzerland --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*